US005115804A

United States Patent [19]

Brookman

[11] Patent Number: 5,115,804

[45] Date of Patent: May 26, 1992

[54] PROTECTIVE HOOD AND ORAL-NASAL MASK

[75] Inventor: Michael J. Brookman, Davie, Fla.

[73] Assignee: DME Corporation, Fort Lauderdale, Fla.

[21] Appl. No.: 226,624

[22] Filed: Aug. 1, 1988

Related U.S. Application Data

[63] Continuation-in-part of Ser. No. 81,834, Aug. 5, 1987, abandoned.

[51] Int. Cl.[5] ..... A62B 17/04

[52] U.S. Cl. ..... 128/201.22; 128/201.23; 128/201.25; 128/205.28

[58] Field of Search ..... 128/202.26, 201.25, 128/202.27, 205.12, 205.28, 201.22, 201.23

[56] References Cited

U.S. PATENT DOCUMENTS

| | | | |
|---|---|---|---|
| 1,889,015 | 11/1932 | Davis | 128/205.28 |
| 2,048,059 | 7/1936 | De Boudemange | 128/202.26 |
| 2,821,192 | 1/1958 | Monro | 128/201.25 |
| 3,381,454 | 5/1968 | Sponsel | 128/205.25 |
| 4,231,118 | 11/1980 | Nakagawa | 128/201.25 |
| 4,552,140 | 11/1985 | Cowley et al. | 128/201.25 |
| 4,559,939 | 12/1985 | Levine et al. | 128/201.25 |
| 4,637,383 | 1/1987 | Lopez | 128/201.25 |
| 4,807,614 | 2/1989 | Van der Smissen et al. | 128/201.25 |

*Primary Examiner*—Edgar S. Burr
*Assistant Examiner*—Aaron J. Lewis
*Attorney, Agent, or Firm*—Malin, Haley, McHale, DiMaggio & Crosby

[57] ABSTRACT

The instant invention is a respiratory system for use on aircraft or similar compartments to temporarily prevent asphxiation and suffocation due to the presence of smoke, toxic gases and/or noxious gases resulting from aircraft fire or similar such. The respiratory system consists of a small dropout package containing a protective hood for deployment to enclose the head of the passenger to improve the passenger's vision in the smoke, a protective breathing mask for enclosing the mouth and nose of the passenger in order to provide breathable air and a dual air supply system. The respiratory system provides a connection to a fresh, breathable air supply from the aircraft's emergency air source and provides a chemical air purifier preferably including a wet scrubbing system for purifing cabin air of contaminants to supply additional breathable air. The respiratory system is disengageable from the aircraft's emergency air source for evacuation.

11 Claims, 6 Drawing Sheets

PROTECTIVE HOOD AND ORAL-NASAL MASK

This is a continuation-in-part of U.S. application Ser. No. 07/081,834, filed Aug. 5, 1987 now abandoned Aug. 8, 1989.

BACKGROUND OF THE INVENTION

1. Field of the Invention

The present invention relates to a respiratory system and more particularly, is concerned with providing fresh, breathable air from contaminated air for use in aircraft and providing visibilty to escaping aircraft passengers involved in an aircraft fire as well as other vehicle use and non-vehicle use. When installed in an aircraft the present invention embodies the function of the present supplemental oxygen mask, common in the art and referred to as the "gold cup", providing supplemental oxygen in cases of aircraft decompression.

2. Description of the Prior Art

In the past, many smoke hoods have been designed to protect the wearer by providing fresh breathable air from air in environments contaminated by smoke and noxious gases.

The patent to Levine, U.S. Pat. No. 4,559,939 discloses a supplemental air tank and hood system. The patent to Birch, U.S. Pat. No. 4,116,237 discloses a supplemental air tank and hood system. These devices only provide dry filters that mainly remove particulates.

The Wong invention, U.S. Pat. No. 4,554,683 provides a barrel shaped smoke hood to provide the wearer with a volume of breathable air within the hood sufficient to sustain the wearer for a short period of time. This hood works in situations involving high rise building fires where fresh, breathable air is available for a period of time prior to contamination by smoke and noxious gases. The major drawback of this hood when used in the aircraft fire situation, is the consumption of the fresh, breathable air and generation of carbon dioxide within the hood, leading to hypercapnia and anoxia. In the aircraft fire situation, the time from onset of fire to time of evacuation may exceed the capacity of the Wong invention.

The instant invention provides an oral-nasal mask which may be connected to any air supply and may be connected to an aircraft's emergency air supply and an air purification system through a wet chemical filter such that fresh, breathable air is available to the passenger at any point during the fire thereby eliminating the need to "fill" the hood with fresh air prior to donning the hood. The oral-nasal mask provides breathable air prior to placement of the hood over the head of the user and after placing the hood over the user's head.

While the Wong invention does mention that optional filters may be attached to the barrel shaped hood, the hood may not provide the passenger with fresh, breathable air prior to the passenger's asphyxiation or suffication due to the smoke and noxious fumes even with the incorporation of the optional filters. Because the hood allows atmospheric air, which is likely to be contaminated in the aircraft fire case, into the hood prior to incorporation on the wearer, the wearer will have to take several breaths of contaminated air before any filtering system allows the purified air to enter the barrel shaped hood. Survivors of recent aircraft fires have stated that one and two breaths of the smoke and noxious gases present in the aircraft fire resulted in the passenger's lungs feeling solidified and in the passenger's experiencing extreme sleepiness. The passengers of aircraft fires cannot risk taking several breaths of the contaminated, toxic, atmospheric air within the Wong hood prior to receiving the purified air where such immediate and critical symptoms occur from one or two breaths.

The instant invention provides a compact oral-nasal mask and hood. The invention incorporating the oral-nasal mask does not require a user or passenger to take several breaths of the contaminated, surrounding atmospheric air prior to receiving the fresh, breathable air. The oral-nasal mask is of relatively small volume, just sufficient to cover the user's or passenger's mouth and nose region such that the passenger will receive fresh, breathable air immediately upon the user's or passenger's first breath from a supply or from the aircraft supply and/or from the surrounding air filtered through the wet and dry purification filter.

Further, traditional filters are not effective in removing some toxic materials, specifically Hydrogen Cyanide, Hydrogen Chloride, Hydrogen Floride, and Carbon Monoxide, some of the more lethal and commonly occurring gases in modern building fires or in airplane fires. The disclosed chemical filter system employing both a wet and dry chemical cleansing system within the instant invention is more effective in reducing levels of Hydrogen Cyanide, Carbon Monoxide and other gases which enter the filtration system. The wet filter scrubs the incoming contaminated air in a wet bath of bases to neutralize the acidic toxic gases. A porous plastic material is used that allows the liquid to remain inside the purifier but allows the user's lungs to draw the contaminated air through the interior of the porous plastic section. The porous plastic material is a hydrophobic material composed of polyethylene or other common plastics, a tradename common in this application is POREX POROUS POLYETHYLENE.

Smoke hoods that have been proposed are disclosed in several prior patents including: U.S. Pat. Nos. 4,554,683, 4,231,118, 3,562,813, and 3,458,864. However, the novelty of the instant invention is the relatively small compact respiratory system for use in a building or vehicle or an aircraft and in leaving same. The respiratory system also includes a wet chemical scrubbing filter for cleaning a room or cabin air of toxic and other gases connected to the oral-nasal mask, the combination of a collapsible hood that is connected to the oral-nasal mask allowing the oral-nasal mask to be placed over the user's nose and mouth prior to covering the user's eyes with hood. While the above mentioned inventions utilize the protective hood to surround the user with breathable air, the protective hood in the instant invention has as one of its primary purpose, not to surround the user with fresh air, as the oral-nasal mask already provides this, but to insulate the user's eyes from the irritating effects of the noxious gases and soot disposition by filling the hood with the user's exhaust gases from the oral-nasal mask. In addition, the present invention provides the passenger with fresh, breathable air before the user or passenger dons the smoke hood. This psychological advancement provides the passengers with the security of fresh breathable air before surrounding their heads with the air impervious hood.

In addition, no other prior art incorporates a dual air supply system providing the user or passenger with either, or both, fresh air from the local supply aircraft's emergency air source if provided or from the contaminated surroundings by filtering same through a wet chemical filter. The instant invention may rely entirely upon the ambient air supply to provide the user or passenger with fresh, breathable air from contaminated surrounding air for a temporary period sufficient to escape from the room, the surrounding area or the cabin of an aircraft. The filtering system is stored in the cup-like oral-nasal mask. The hood that may be easily placed over the user or passenger is conveniently attached to the outside of the oral-nasal mask.

Consequently, a need exists for an aircraft respiratory system incorporating both an oral-nasal mask providing the passenger with fresh, breathable air from alternative sources, the aircraft's emergency air source and an air purifier source that removes contaminants from the surrounding cabin air, and a protective hood to insulate the passenger from the smoke and noxious gases associated with an aircraft fire to improve passenger's visibility by filling the hood with the user's exhausted gas during an escape from the aircraft. The same compact respiratory system may be used in other vehicles or by firemen or the like. The wet chemical air purifier continues to work after the user detaches himself from the bottled air or the aircraft's emergency air in order to exit the area, room or aircraft.

SUMMARY OF THE INVENTION

The present invention provides a respiratory system for users of rooms and various areas that may have emergency fires as well as passengers of aircraft involved in aircraft fires sufficient to temporarily maintain the user or passenger's air supply and visibility as well as for other aircraft emergencies such as loss of cabin pressure at high altitudes. The instant invention embodies in the existing drop down oral-nasal mask two air supply systems. First, the ordinary bottle emergency air or airplane emergency air supply system that allows the user or passenger to breath directly from the emergency air source. Second, from a filtering system, a wet chemical air purifier, stored in the cup shaped mask that scrubs toxic and other gases that are taken in from the surrounding room, area or cabin air to purify same for human use in breathing in the event of a fire in the room, area, or cabin. A hood is connected to the outside of the cup shaped mask for easy access after the user or passenger places the mask over his nose and mouth. Such a dual respiratory system with a small compact wet chemical air purifier has not been incorporated in prior aircraft respiratory systems.

Accordingly, the instant invention for providing temporary life support to permit each user or passenger involved in a room fire, area fire or aircraft fire includes the ordinary drop down oral-nasal mask to cover the passenger's mouth and nose region and to surround the passenger's mouth and nose region with fresh, breathable air, a protective hood to insulate the user's or passenger's eyes from the irritant effects of smoke and noxious gas when the hood is filled with the use's exhaust gases, and an air purifier to provide the user or passenger with fresh, breathable air in addition to the aircraft's emergency air source or to provide the user or passenger with the fresh, breathable air after the bottled air or aircraft oxygen is depleted or turned off or the passenger has disconnected himself from the bottled air or aircraft supply when exiting the room, area or aircraft. In the instant invention, the preferred embodiment allows the user or passenger to initially breath the two types of air first, the bottled air or the aircraft's emergency air source and second, the purified room, area or cabin air source through the wet filter.

It is an object of this invention to provide in a drop down assembly or pull down assembly or pull out assembly: an oral-nasal mask, an air purifier system stored in the cup shaped mask, and a hood connected to the outside of the cup shaped mask for use in an area or vehicle as well as when exiting the area or vehicle. In an aircraft installation this assembly would be the overhead passenger service unit. This invention would replace the "gold cups" in that assembly.

Another object of this invention is to provide a wet filter and systems that allow the user to breath from an air supply and from surrounding air through the wet filter.

In accordance with these and other objects which will be apparent hereinafter, the instant invention will now be described with particular reference to the accompanying drawings.

DESCRIPTION OF THE PREFERRED EMBODIMENT

Figure 1:
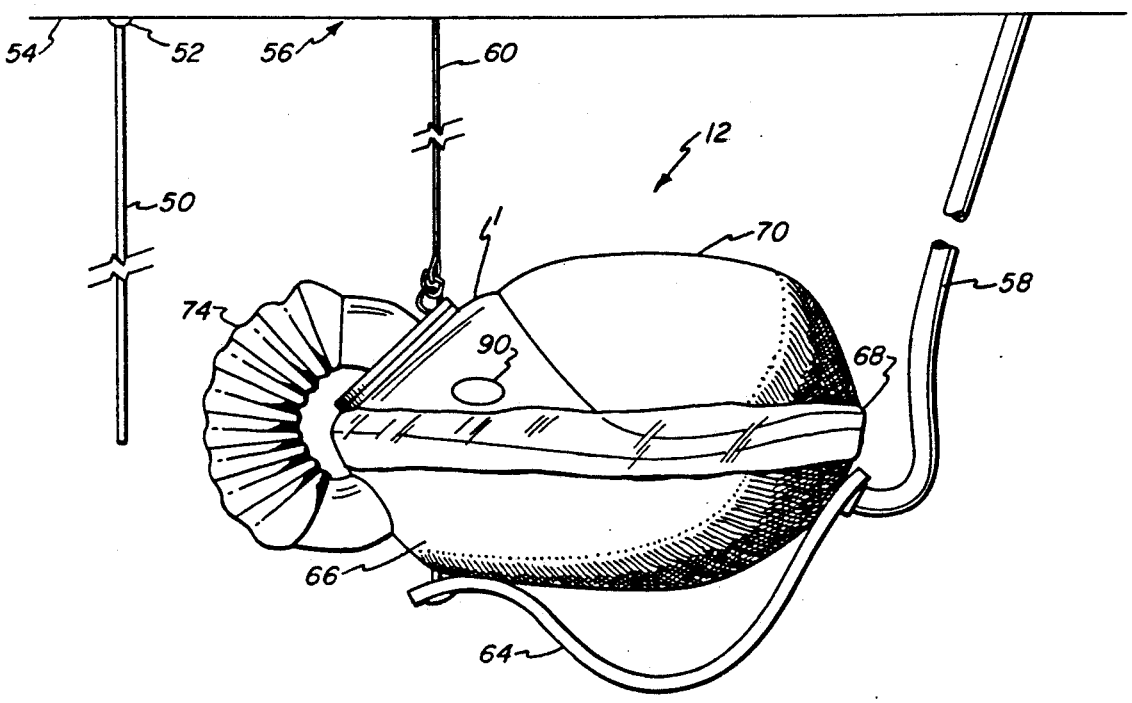
FIG. 1 is a perspective view of the respiratory system emerging from the ceiling on a lanyard and an oxygen tube of the aircraft with the oral-nasal mask, wet and/or dry chemical air purifier system behind a sealed cover, and hood under a cover connected to the outside of the mask.
Figure 2:
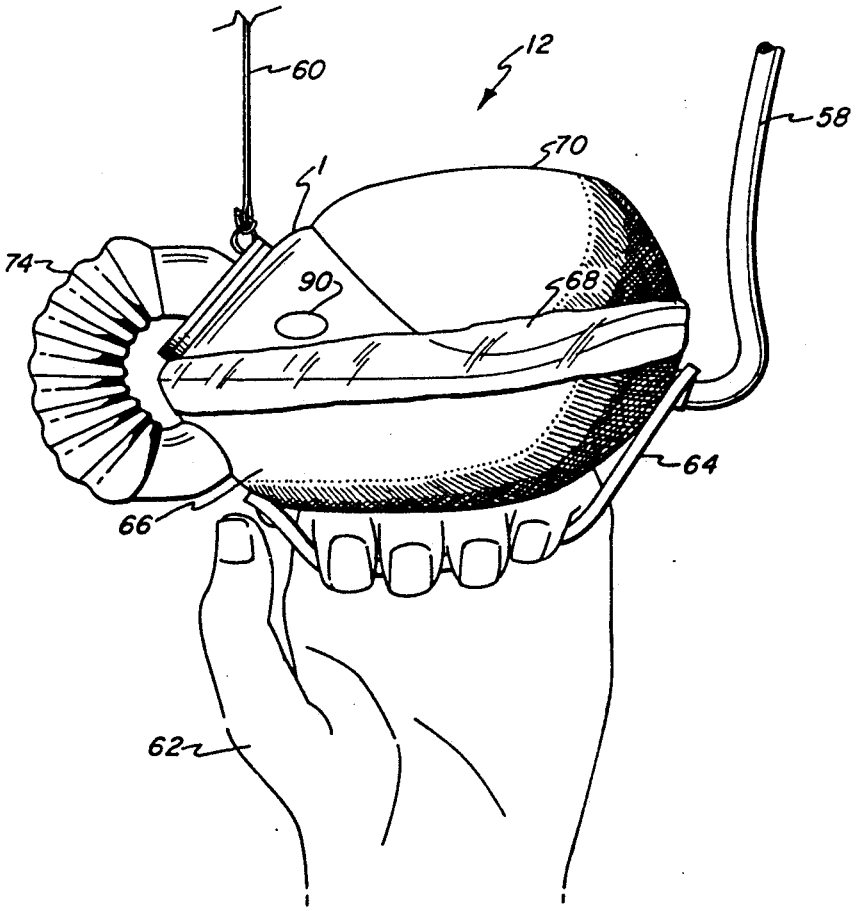
FIG. 2 is a perspective view of a user or passenger user grabbing the respiratory system.

This is a new and improved invention for a respiratory system 12 shown in FIGS. 1 and 2, for use by an individual carrying bottled air or in a vehicle, such as an aircraft. The system 12 provides users and aircraft passengers with fresh, breathable air in case of smoke, fire or rapid decompression from an air supply or an aircraft supply and from purified room, area or cabin air and to improve the user's or passenger's visibility and breathing during an escape when the air supply or aircraft supply is disengaged or depleted. The respiratory system 12, includes an oral-nasal mask 1, composed of semi-flexible material constructed from film or injection molded. The mask includes an open cup-shaped interior 5 shown in FIG. 4, to engage upon the user's or passenger's mouth and nose region 2 shown in FIG. 5, to isolate the user's or passenger's mouth and nose region 2, from the contaminated area, room or cabin atmosphere surrounding the user's head. The oral-nasal mask 1, is generally cup shaped with edges 7 and 7', contoured to substantially conform to a human face and particularly, to contour to the passenger's cheekbones 8, and chin 9. This prevents the inflow of area air into the nose-mouth piece.

Figure 3:
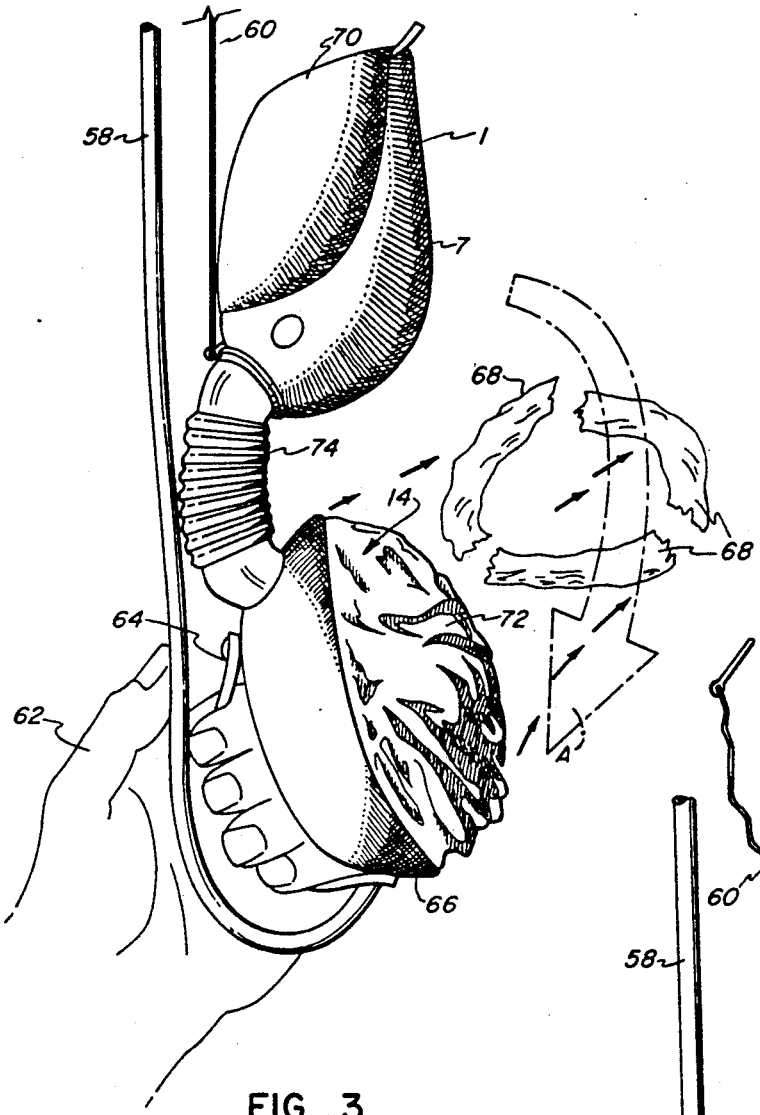
FIG. 3 is a perspective view of the user or passenger releasing the wet chemical air purifier system from behind the cover and in breaking the seal between the oral-nasal mask and wet chemical air purifier system and extending the purifier system away from the cover with the breathing tube extended.

Door 50 of the storage container opens either manually or automatically. Illustrated is an airplane's storage container. The door 50 hangs down on hinge 54 to open the small overhead compartment to allow the respirator system 12 to drop out as shown in FIG. 1. The system 12 may be pulled out of the small storage container 56. The oxygen or air tube 58 and lanyard 60 are connected to the respirator system 12 and the inside of the small storage compartment 56. The user's hand 62 grabs handle 64 and pulls as shown in FIG. 2 the purifier shell 66 as shown by arrow A in FIG. 3 from the mask 1 and upper shell 70. The plastic seal 68 is broken as shown in FIG. 3 and cap 66 is placed in an in-use position as shown in FIG. 3 exposing the outer filter 72 of the wet chemical air purifier 14 that is below filter 72. The purifier shell 66 is supported by lanyard 60.

Figure 5:
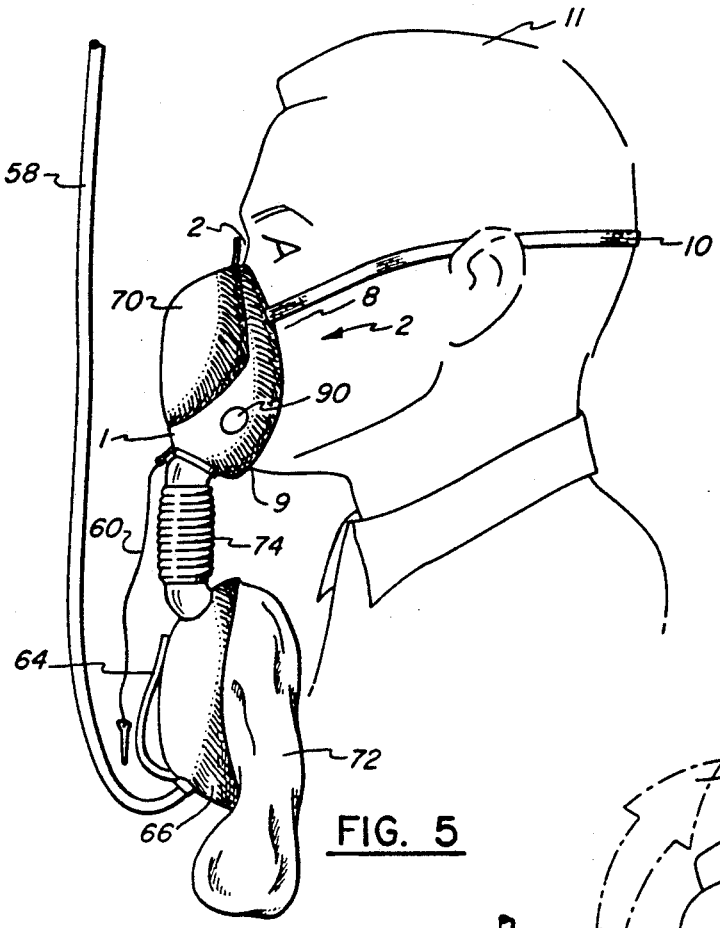
FIG. 5 is a view of the oral-nasal mask and wet chemical air purifier in position on the user's or passenger's head.

An elastic band 10, is attached to the oral-nasal mask 1, near the edges 7 and 7'. The passenger extends the elastic band 10, behind the passenger's head 11, to compress the oral-nasal mask 1, against the passenger's mouth and nose region 2 to maintain oral-nasal mask 1, with a substantially airtight seal around the passenger's mouth and nose region 2 as shown in FIG. 5. The elastic band would allow exhaled air to move out around the edges 7 and 7' by reason that the nose-mouthpiece has a one-way valve to allow air into the mouthpiece from tube 74. To keep a tight seal at all times, one way exit valves 90 are located on the nose-mouthpiece 1. The elastic band 10, also supports the rest of the respiratory system 12, in place without further assistance. The elastic band 10, is flexible and is easily folded into the interior 5 of the oral nasal mask 1 along with a portion of the wet chemical air purifier 14, for storage purposes.

Figure 8:
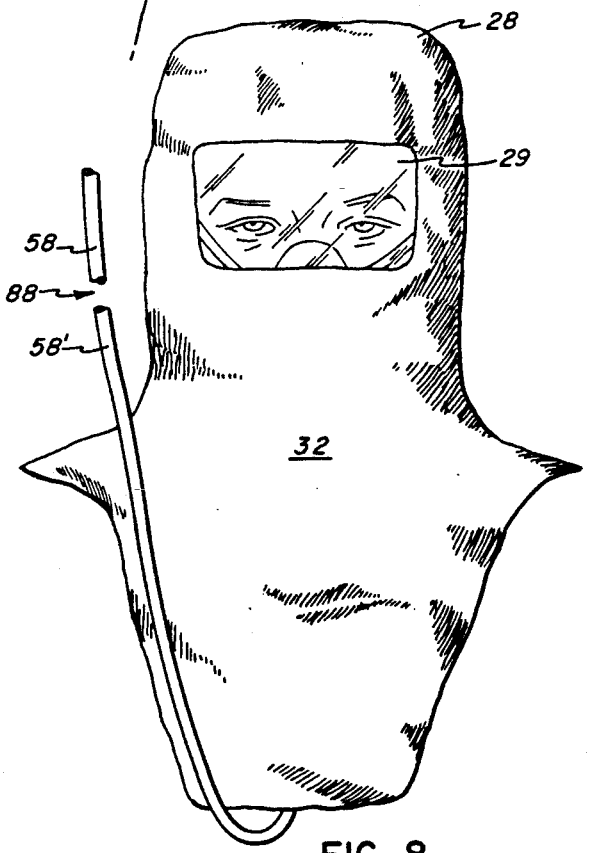
FIG. 8 is a front view of the user or passenger in FIG. 7 illustrating the supply air tube or the stored air tube severed from the bottled air or aircraft to allow the user or passenger to exit the room, area or aircraft.
Figure 9:
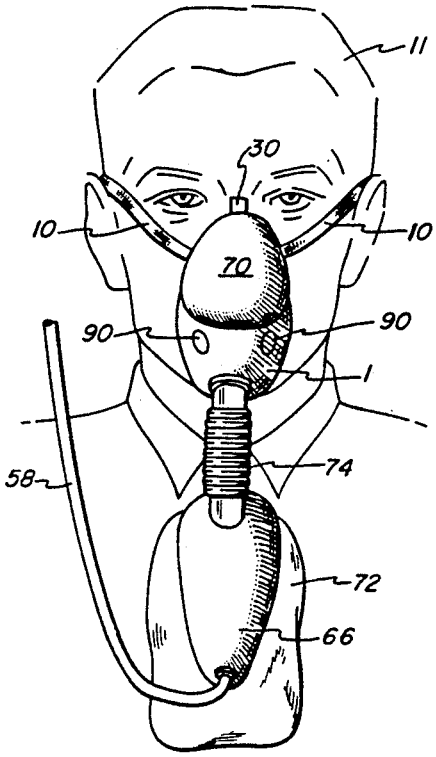
FIG. 9 is a perspective view of the user or passenger in FIG. 7 with the hood stored under the hood cover.
Figure 10:
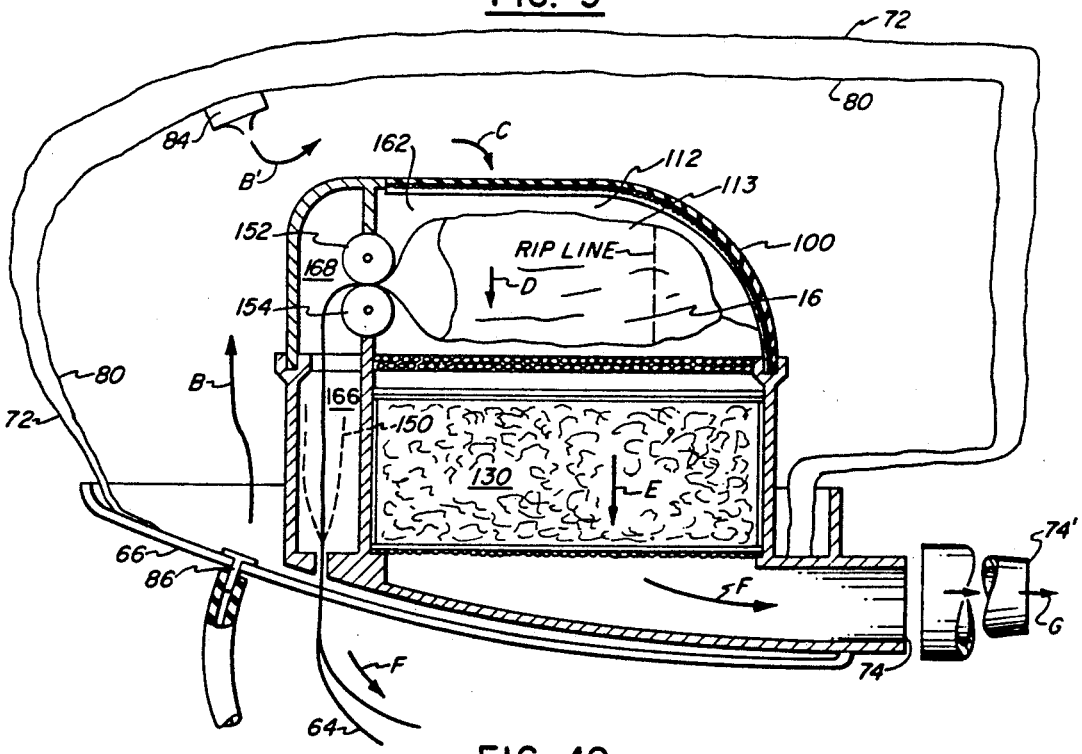
FIG. 10 is a cross section of the purifier shell showing the air passages and the internal configuration of the wet and dry air purifier.
Figure 11:
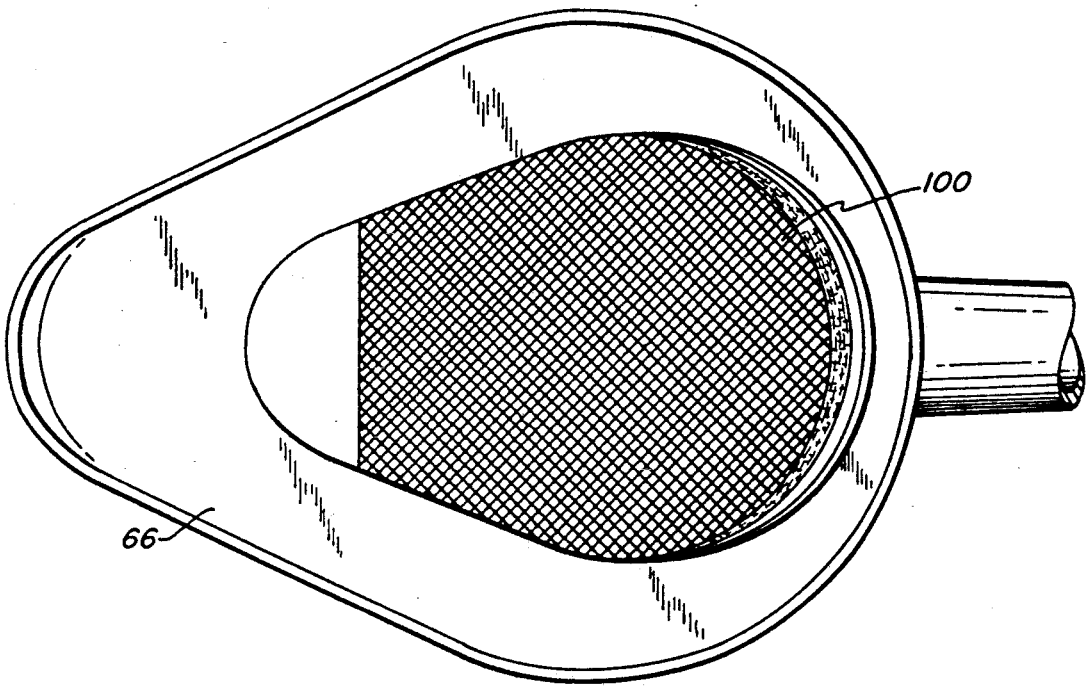
FIG. 11 is a top view of FIG. 10 with the right portion tilted upward.

The oral-nasal mask tube 58 is connected to the purifier shell 66, with a passageway shown by arrows B, C, D, E and F shown in FIG. 10 into the oral-nasal mask 1. The tube 74 extends into the interior 5, or the oral nasal mask 1 and may have a one-way valve in tube 74. The end of tube 74, of the oral-nasal mask tube 74, extends into the interior 5, of the oral-nasal mask 1, are unblocked and provide the path for fresh, breathable air to enter the oral-nasal mask 1. The sealed air bag 80 has a one-way flapper valve 84 to allow air to come into the air passageway as shown by arrow B'. Outside of flapper valve 84 and bag 80 is particulate filter 72 for filtering out larger particles. The area, room or aircraft air enters at 86. The tube 58 may be broken at 58' as shown at 88 in FIG. 8 or the tube 58 may be pulled off entrance member 86.

Figure 4:
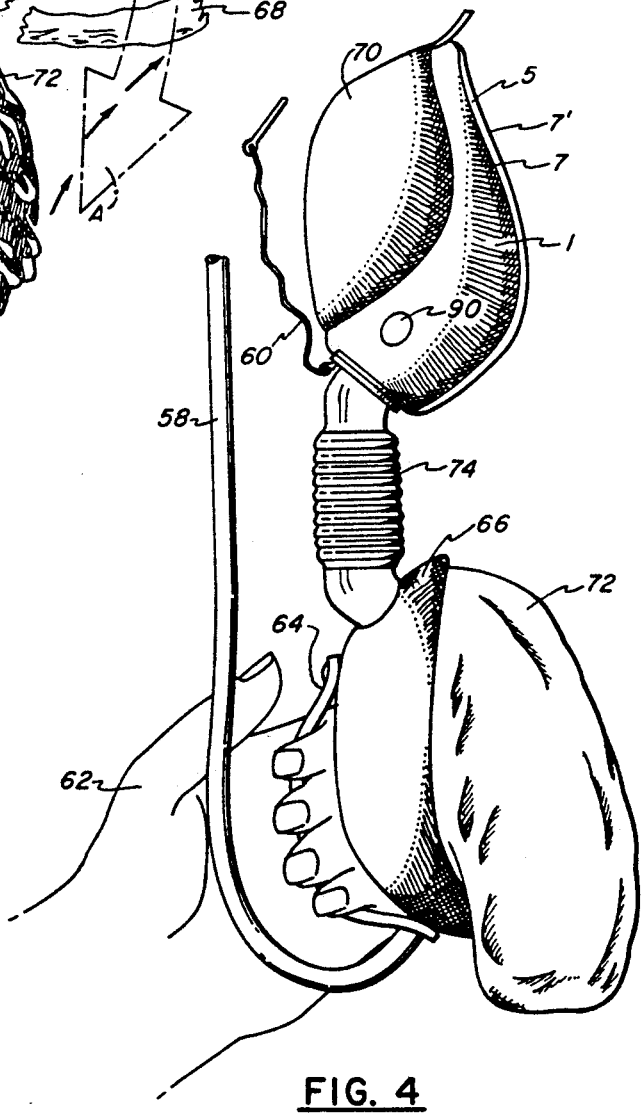
FIG. 4 is a perspective view of the oral-nasal mask and air purifier in its extended position for use and the lanyard disconnected.

When the lanyard 60 is pulled down by handle 64 disengaging it from its attachment within storage container 56, air through 58 fills bag 80 and expands filter 72 as shown in FIG. 4. The user as shown in FIG. 5, breaths air from tube 58 through passageways B, C, D and E and from the cabin air through valve 84.

The user breaths air in through the oral-nasal mask 1 and exhales into the mask out through one-way valve 90.

The wet chemical air purifier 14, is a multichambered assembly of chemicals and filter media, designed to effectively remove the critical levels of harmful, noxious gases and smoke from the atmospheric air coming through particle filter 72 and one or more one-way valves 84 in the plastic non-porous plastic breather bag 84. The air from the cabin coming through valve 84 first passes through rigid purifier structure and filter 100. The material making up filter 100 is a combination of metal or plastic screen, various filtering media common in the art and a hydrophobic porous membrane 112 to enclose the wet filter. In the first chamber 110, porous plastic membrane 112 allows gases to pass through from filter 100 filter 120 but keeps the wet chemical within membrane 112. The gas is scrubbed as it passes through first chamber 110. Acid gases are neturalized in first chamber 110 containing wet base materials. The gases are neutralized before they pass through filter 120 and on through the second chamber 130. Chamber 130 catalyzes CO to $CO_2$, by passing the gas stream through a catalyst such as hopcalite, a mixed metal oxide to provide breathable air at F. The air purifier 14, consists of a first chamber 110 which contains a sac 113 to store the wet base materials until activated by pulling actuator, 64. The wet chemical air purifier 14, is completely enclosed and seals the active chemical agents 16 within the first chamber 110 and sac 113 from the atmosphere. The chemical may be both wet and/or dry when activated for use.

The chemical portion of the air purifier in membrane 112 and in sac 113, is actuated by the pull on handle 64 relative to lower cap 66 that pulls cord 150. The cord pulls air sac 113 between rollers 152 and 154 to rupture sac 113 and displace chemical agents 16 into first chamber 110, as described hereinafter. The chemical portion of the air purifier in first chamber 110, has two parts, each of which may be either wet or dry, which are mixed at the time of actuation, to provide effective neutralizing solution for wet filtration of the noxious and toxic gases as they pass through the filter before moving on through the dry filter portion of the air purifier 14.

As illustrated in FIG. 4, the air purifier 14, rests partially in the interior 5, of the oral nasal mask 1, while in storage, prior to deployment. In this state, cord 150 is attached to handle 64 and one end of sac 113 The opposing end of the pull cord 150 when pulled downward as shown in FIG. 10, pulls the sac 113 storing the liquid component of the purifier. The end of the pull cord 150 is attached to the sac 113 within the air purifier first chamber 110. As the passenger pulls the handle 64, releasing the purifier shell 66 holding the air purifier 14, to deploy the oral nasal mask 1, the tension on the cord 150, causes rupture of the wet sac 113, releasing the wet chemical into the surrounding dry chemical agent 162. As the user or passenger continues to pull on the handle to pull on the lanyard 60 to release air from the air craft storage into the air breather bag 80. The cord 150 will again be pulled to ensure the breaking of sac 113 in first chamber 110 when the user is preparing the mask 1 for deployment. The release of wet chemical 164, which may be water solutions of various alkaline hydroxides or similar base solutions, into the dry chemical 162 which may be a mixture of metal hydroxides, or metal oxides, fully actuates the wet chemical air purifier and filtering system.

The aircraft emergency air can enter the air purifier 14, through the air tube 58 through entry tube 86 through passage 166 and 168 into chamber 110 and through chamber 130, and through tube 74 into the mask 1. A one-way valve only allowing air to pass into compartment 166 from entry 86. At each stage the elements are sealed to require passage of air in the desired direction. the fresh, breathable air from the bottled air or aircraft's emergency air source enters the air tube 58 from the aircraft supply system or storage means. Because the fresh, breathable air from the bottled air or aircraft's emergency air source is non-contaminated, it does not react with the chemicals in first chamber 110 as it proceeds through first chamber 110, through second chamber 130 and enters the oral-nasal mask tube 74 which passes the air into the oral-nasal mask 1, where it is inhaled by the user or passenger.

Also attached to the air purifier 14, is an atmospheric valve 84 or additional valves within filter 72. The valve 84 is open to the atmosphere in the cabin allowing the contaminated air into the air purifier through filter 100. The area, room or cabin air passes through the first chamber 110 and the second chamber 130 and out through tube 74 into the mask 1.

The user can breath both bottled air or aircraft supply air and purified area, room or cabin air in a percentage governed by the pressure of the aircraft supply air and the design pressure of the valve 84 for example 60% bottled air or aircraft supply air and 40% area, room or cabin air. In the case of ripid decompression of an aircraft, the user's air is substantially provided by the aircraft supply.

The valve assembly 84 may be redesigned in another embodiment so that the valve 84 will remain "normally closed", blocking the flow of the contaminated air from the cabin into the wet chemical air purifier 14, until the internal pressure of air from the bottled air or aircraft supply system, is reduced below a design pressure or the ambient pressure of the area, room or cabin. This reduction would result from reduced flow through the air tube 58, or increased flow demand by the user or passenger. The internal pressure within the air purifier caused by the flow of fresh, breathable air into the air purifier 14, via the air tube 58, may also act to force the closure of the valve 84 (depending on the design features), until the flow of fresh, breathable air via the air tube 58, ceases. The valve assembly 58, may be a simple flapper valve well known in the art.

The air tube 58, has a breakpoint or may be pulled off the entrance connection, where the air tube is easily separated thereby disconnecting the passenger from the aircraft's emergency air source and giving the passenger the mobility necessary to escape the aircraft. Upon disconnection of the air tube, the entrance into the air purifier is exposed to the contaminated atmospheric air thereby allowing additional contaminated, cabin air into the air purifier. Because the contaminated air contains smoke, toxic gases and noxious gases, the wet and dry chemical materials in the air purifier reacts with and removes the smoke, toxic gases, and noxious gas from the contaminated air thereby rendering the air fit to breath. The purified air is then pulled through the oral-nasal mask tube by the force of the passenger inhaling from the oral-nasal mask 1, such that the passenger can temporarily continue to breath purified, breathable air despite the disconnection of the air tube 58, from the bottled or aircraft's emergency air source.

In the event the user or passenger neglects to remove or break the air tube, to afford the user or passenger's escape from the area, room or aircraft and the bottled air or aircraft's emergency air source becomes depleted, the respiratory system, will always automatically deliver fresh, breathable air to the user or passenger despite the air source depletion. The respiratory system 12, accomplishes this using the flapper valve 84 attached to the breather bag. When the user or passenger inhales against the depleted emergency air source, a vacuum is created in the interior of chambers 110 and 130 within the air purifier 14. In an attempt to equalize internal pressures, the higher pressured air in the area, room or cabin moves through the filter 100 toward the lower pressured air in the air purifier 14. The force of the higher pressured area, room or cabin air moving into the air purifier 14, lifts the flapper valve 84, to the open position thereby allowing cabin air into the air purifier to be cleansed by the chemical material prior to delivery to the user or passenger's mouth and nose, via the oral-nasal mask 1.

The interior 5, of the oral-nasal mask 1 is sterilized prior to use of the respiratory system 12, to promote cleanliness. The air purifier 14, is shaped to engage against the edges 7 and 7' of the oral-nasal mask 1, to seal the interior 5 of the oral-nasal mask 1, and to prevent the oral-nasal mask 1 from losing its sterility prior to use by the passenger. The user or passenger breathes air in through tube 74 and exhausts air out flapper valves 90.

The hood 28, is folded and attached on the exterior, near the apex, of the cup shaped oral-nasal mask 1 below cup 70, see FIG. 6, in the respiratory system's storage state, prior to deployment. The upper cap 70 is positioned over the hood 28. The lens 29 may be flexible and generally curved to lay flat against the exterior of the mask 1 or in a folded position just underneath the folded hood 28.

Figure 6:
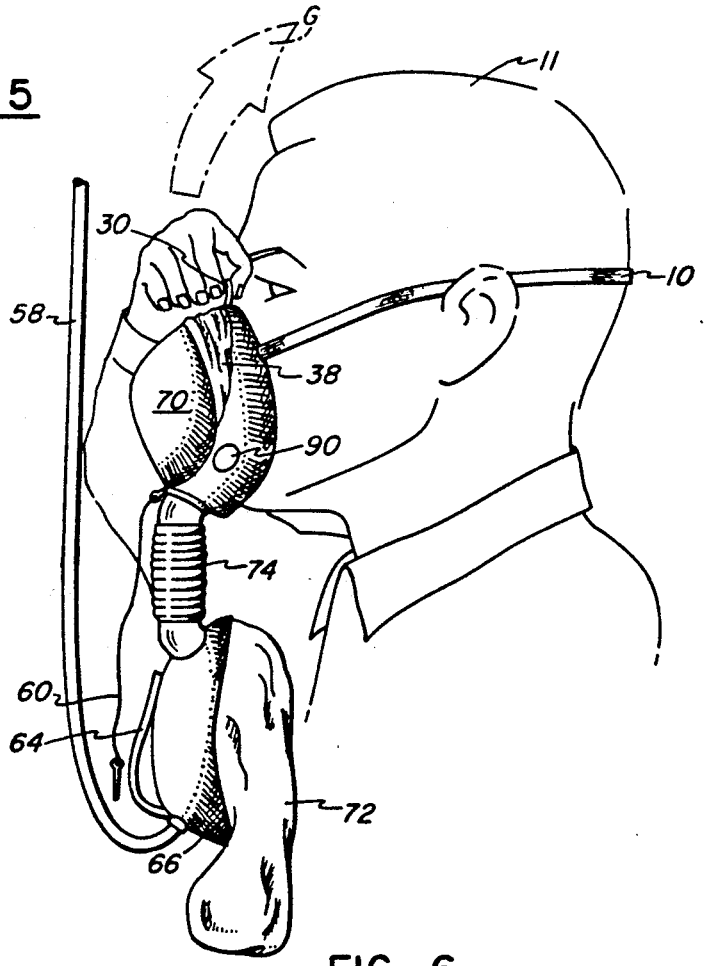
FIG. 6 is a perspective view of the user or passenger beginning to release the hood on the oral-nasal mask.
Figure 7:
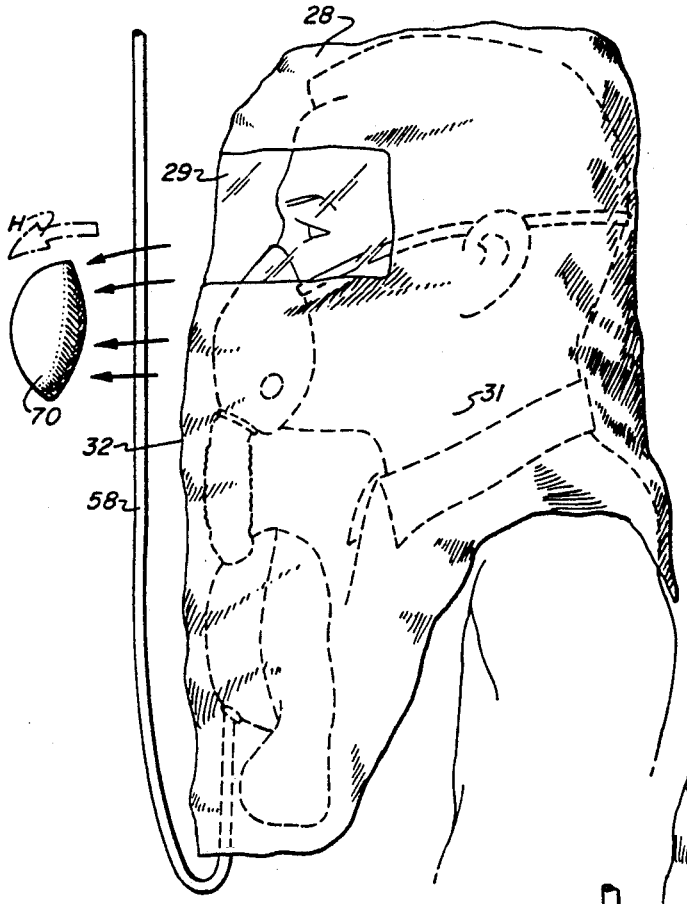
FIG. 7 is a perspective view of the user or passenger having pulled the mask over his head and the oral-nasal mask.

A hood tab 30, is attached to the hood 28, to allow the user or passenger to quickly grab one tab as shown in FIG. 6 or more tabs in at least one hand to pull outward in order to pop off the upper cap in the direction of arrow H as shown in FIG. 7. The hood in then pulled as shown by arrow G off of the oral-nasal mask 1, and over the user's or passenger's head 11 as shown in FIG. 7. The hood tab is conspicuously positioned substantially in front of the wearer's eyes to promote awareness of the availability of the smoke hood attached to the oral nasal mask 1. When properly placed, the hood 28, covers the passenger's entire head and neck area 31 and generally over the shoulders. The lens 29 is positioned substantially in front of the user's or passenger's eyes. The front 32, of the hood 28, may include a short slit to allow the air tube 58, to run from the lower cup of the air purifier 14, to the bottled air or aircraft's emergency air source or it may extend out from under the bottom of the hood as shown in FIG. 7.

The lens 29, may be formulated of Kapton polymer and is transparent to promote visibility in the presence of dense smoke.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A respiratory system for a user, said system being a generally passive unit, not requiring a generated source of pure oxygen, to directly meet respiratory requirements, comprising:

protective hood means constructed and arranged to cover and enclose the user's head and neck area, said hood means fabricated of a non-flammable, gas impermeable material, said hood means including at least one viewing means made of generally rigid, transparent material located substantially in front of the user's eyes for providing a user wearing said hood means over the user's head with visibility outside said hood means, whereby the user's eyes are protected from the effects of irritant gases and soot disposition resulting form toxic fire or the like, and whereby the user may see in a smoke filled atmosphere;

an oral-nasal mask means for a user, connected to said protective hood means, said oral-nasal mask means for covering at least one of the user's air intake means, said mask means fabricated of semi-flexible material and constructed and arranged to conform to the contours of the user's mouth and nose region to form a relatively tight seal around the user's air intake means, whereby the user is protected from suffocation, asphyxiation, or other injury due to smoke or toxic gas inhalation, or aircraft rapid decompression;

means for holding said mask means in position on the user's face;

a chemical air purifier means for converting atmospheric air filled with hot smoke, noxious gas and other gases into temperate, breathable air;

said air purifier means being separate from, and independent of, said hood means, said air purifier means for constantly filtering said atmospheric air without the necessity of, or requirement for, said hood means, said air purifier means including an oxidation catalyst media, acid neutralizing media, and filtration media;

means for transporting atmospheric air to said air purifier means; and means for connecting said mask means to said air purifier means, whereby clean air from said purifier means is transported to said mask means to be breathed by the user of said respiratory system.

2. A resiratory system as described in claim 1, wherein:

said hood includes flexible material to allow said hood means to be folded into a compact hood package removably connected to said mask means.

3. A respiratory system as described in claim 2 wherein:

said mask means having connecting means for attaching said hood package in a collapsed position to said mask means and having additional connecting means for attaching said air purifier in a collapsed position to said mask means, said hood means and said air purifier means in a collapsed position connected to said mask means for providing a compact package needing little storage space, said air purifier includes a wet chemical air purifier.

4. A respiratory system as described in claim 3 wherein:

said mask means including a cup shaped concave surface, said air purifier means attaches in said concave surface, for providing an improvised cover for said mask means such that said mask means is kept substantially clean prior to contact with the user's air intake means.

5. A respiration system as described in claim 1, wherein:

said hood means and said chemical air purifier of said respiration system is assembled from a collapsed position into a useable position in airplanes and aircraft to provided visibility for evacuating an airplane or aircraft and to provided breathable air for evacuating an airplane or aircraft in the event of a crash.

6. A respiratory system as described in claim 1 further comprising means for connecting said air purifier means to a source of breathable, pressurized oxygen.

7. A respiration system as described in claim 6, wherein:

said source of breathable oxygen is said airplane or aircraft's emergency oxygen supply.

8. A respiratory system as described in claim 6 wherein said means for connecting said air purifier means to a source of breathable, pressurized oxygen further comprises means for disconnecting said air tube from said source of breathable, pressurized oxygen.

9. A respiratory system as described in claim 1 wherein said means for transporting atmospheric air to said air purifier means comprises:

a tube having a first and second end, said first end operably connected to said air purifier means whereby air within said tube may move into said air purifier means; and an atmospheric inlet, operably connected to said second end of said tube, having means for allowing the flow of ambient atmospheric air into said tube.

10. A respiratory system as described in claim 1 further comprising:

means for connecting said air purifier means to a source of breathable, pressurized oxygen;

a tube having a first and a second end, said first end operably connected to said air purifier means, whereby air within said tube may move into said air purifier means; and an atmospheric inlet, operably connected to said second end of said tube, having means for allowing the flow of ambient atmospheric air into said tube.

11. A respiration system as described in claim 10, wherein:

said respiration system includes a standard aircraft overhead oxygen mask compartment, and said hook means, said mask means, said means for holding said mask means in position, said air purifier means, said means for connecting said air purifier means to a source of breathable, pressurized oxygen, said tube, and said atmospheric inlet are collapsibly stored in said standard aircraft overhead oxygen mask compartment, replacing the present means of aircraft decompression protection: the common gold cup.

* * * * *